United States Patent [19]

Aotsuka et al.

[11] Patent Number: 4,868,097

[45] Date of Patent: Sep. 19, 1989

[54] HEAT DEVELOPMENT DYE IMAGE FORMING METHOD WITH SURFACE ACTIVE AGENTS

[75] Inventors: Yasuo Aotsuka; Masatoshi Kato; Masakazu Yoneyama, all of Minami-ashigara, Japan

[73] Assignee: Fuji Photo Film Co., Ltd., Kanagawa, Japan

[21] Appl. No.: 185,658

[22] Filed: Apr. 25, 1988

[30] Foreign Application Priority Data

Apr. 24, 1987 [JP] Japan ..... 62-102716
Apr. 27, 1987 [JP] Japan ..... 62-104016

[51] Int. Cl.[4] ..... G03C 5/54; G03C 1/38

[52] U.S. Cl. ..... 430/351; 430/203; 430/546; 430/637

[58] Field of Search ..... 430/203, 546, 637, 351

[56] References Cited

U.S. PATENT DOCUMENTS

| | | | |
|---|---|---|---|
| 3,415,649 | 12/1968 | Nishio et al. | 430/637 |
| 4,740,363 | 4/1988 | Hirai et al. | 430/203 |
| 4,761,361 | 8/1988 | Ozaki et al. | 430/203 |
| 4,783,392 | 11/1988 | Aono et al. | 430/203 |

*Primary Examiner*—Richard L. Schilling
*Attorney, Agent, or Firm*—Sughrue, Mion, Zinn, Macpeak and Seas

[57] ABSTRACT

A color image is formed by imagewise exposing a photosensitive material comprising at least (a) a photosensitive silver halide, (b) a binder, (c) a dye-providing substance which forms or releases a diffusible dye in response or counter-response to the reduction of the silver halide into silver at elevated temperatures, and (d) a specific-surface-active agent on a support, and heat developing the photosensitive material to form an image.

6 Claims, No Drawings

HEAT DEVELOPMENT DYE IMAGE FORMING METHOD WITH SURFACE ACTIVE AGENTS

BACKGROUND OF THE INVENTION

1. Field of the Invention

This invention relates to a method of forming images through heat development.

2. Discussion of the Background

Photographic processes using silver halides have been most widely used because of their improved photographic properties of sensitivity and gradation control over other photographic processes including electrophotography and diazo process. An advanced technique which can more conveniently and rapidly produce images through a dry treatment as by heating was recently developed as a substitute for a conventional wet treatment using developing solution in processes for forming images in a photosensitive material based on silver halide.

A number of methods have been proposed for producing color images through a dry process. A process for forming a color image through coupling of an oxidant of a developing agent with a coupler is described in several patents, for example, U.S. Pat. No. 3,531,286 disclosing p-phenylenediamine reducing agents combined with phenolic or active methylene couplers; U.S. Pat. No. 3,761,270 disclosing p-aminophenol reducing agents; Belgian Patent No. 802,519 and Research Disclosure, September 1975, pages 31–32 disclosing sulfonamidophenol reducing agents; and U.S. Pat. No. 4,021,240 disclosing sulfonamidophenol reducing agents combined with four equivalent couplers.

Research Disclosure, May 1978, pages 54–58, RD-16966 describes a process of forming an image by incorporating a nitrogen-containing heterocyclic group into a dye to form a silver salt and effecting heat development to release the dye.

A process for forming a positive color image by heat-sensitive silver dye bleaching process is also well known. Useful dyes and bleaching processes are disclosed in, for example, Research Disclosure, April 1976, pages 30–32, RD-4433; ibid, December 1976, pages 14–15, RD-15227; and U.S. Pat. No. 4,235,957.

A process for forming a color image using a leuco dye is described in, for example, U.S. Pat. Nos. 3,985,565 and 4,022,617.

These color image forming processes, however, have the drawbacks that it takes a relatively long time to complete development and there result heavily fogged images with a relatively low density.

To eliminate these drawbacks, Japanese Patent Application Kokai No. 58-79247 discloses a heat-developable photosensitive material comprising a dye-providing substance which reacts with an oxidant of a reducing agent to release a hydrophilic dye. The photosensitive material used in an image forming method of this type contains a surfactant for the purposes of preventing interlaminar color mixing, fogging, development irregularities associated with the temperature of heat development or the amount of water applied, image irregularities caused by paper making irregularities in a paper support of dye-fixing material, and other defects.

Japanese Patent Application Kokai Nos. 59-57231 and 60-79709, inter alia, disclose polyalkylene oxides, for example,

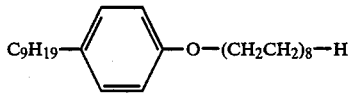

which are found to substantially prevent interlaminar color mixing and fogging.

The surfactant is generally added to a layer, typically an emulsion layer which contains an emulsion (typically oil-protected emulsion) of a dye substance such as dyes and dye-providing substances. Agglomerates often form in these emulsions. It is presumed that since the surfactant breaks the emulsion, the dye substance precipitates to form agglomerates. This phenomenon is outstanding with emulsions of dye substances having a low solubility in oil.

If the surfactant is added to an emulsion-free layer such as intermediate and protective layers to alleviate demulsification, the interface between a surfactant-containing layer and an emulsion-containing layer becomes rough, leaving a problem. This phonomenon becomes outstanding particularly when multiple layers are coated at the same time. The cause is not clearly understood. When the surfactant is added to an intermediate layer, for example, the surfactant starts diffusing into the emulsion-containing layer, for example, through the as-coated surface before the intermediate layer being coated is bonded to the support. Then the viscosity of the emulsion-containing layer is extremely reduced to disorder the interface between the intermediate layer and the emulsion layer. Such a viscosity drop occurs in the emulsion layer probably because an increase of viscosity achieved by the emulsion is offset by demulsification.

It is undesirable that the surfactant which would create agglomerates in an emulsion-containing layer is added to even an emulsion-free layer.

The conventional surfactants are less suitable in the preparation of photosensitive material for the above reason. The demulsifying nature of surfactant may be somewhat alleviated in the preparation of photosensitive material by reducing the amount of surfactant added or adding divided parts of the surfactant to plural layers rather than adding the surfactant to a single layer, but at the sacrifice of intermediate color mixing prevention.

Further, the conventional surfactants are also insufficient in photographic properties including development irregularities and paper irregularities. Image irregularities resulting from paper irregularities become serious when a substantially water-insoluble metal compound is used in combination with a complexing compound capable of complexing with a metal ion of the metal compound as described in copending U.S. Ser. No. 890,442 based on Japanese Patent Application No. 60-169585. When such a base generating method is used, paper irregularities tend to incur irregularities in film thickness and pH, eventually leading to image irregularities.

There is a need for improvements in these problems.

SUMMARY OF THE INVENTION

It is an object of the present invention to provide a novel and improved image forming method which renders eligible the manufacture of heat developable photosensitive material and is successful in improving photographic properties including interlaminar color mixing and fogging.

According to the present invention, there is provided a method for forming an image, comprising the steps of:

imagewise exposing a heat developable photosensitive material comprising on a support at least (a) a photosensitive silver halide, (b) a binder, (c) a dye-providing substance which forms or releases a diffusible dye in response or counter-response to the reduction of the silver halide into silver at elevated temperatures, and (d) a compound of formula (I):

$$[X-(L)_m-]_k-(B)_n-Y \quad (I)$$

wherein

X is a monovalent group containing a polyethylene oxide chain,

L is a divalent linking group,

Y is a water-soluble group, m is equal to 0 or 1, k is a positive integer having a value of at least 1, B is a group having a valence of (k+1), and n is equal to 0 or 1, or a compound of formula (II):

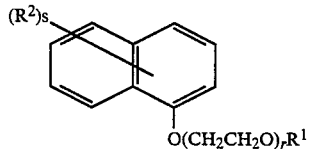

(II)

wherein $R^1$ is hydrogen or a hydrocarbon residue, $R^2$ is a hydrocarbon residue, r is a positive integer having a value of from 5 to 200, and s is 0 or a positive integer having a value of from 1 to 7, and during or after the imagewise exposure of the photosensitive material, heating the heat developable photosensitive material to form an image.

DETAILED DESCRIPTION OF THE INVENTION

The photosensitive material used in the image forming method according to a first aspect of the present invention contains a surfactant in the form of a compound of formula (I):

$$[X-(L)_m-]_k-(B)_n-Y \quad (I)$$

wherein

X is a monovalent group containing a polyethylene oxide chain,

L is a divalent linking group,

Y is a water-soluble group, m is equal to 0 or 1, k is a positive integer having a value of at least 1, B is a group having a valence equal to (k+1), and n is equal to 0 or 1.

The monovalent group containing a polyethylene oxide chain represented by X is preferably of the following formula:

$$A-O-(CH_2CH_2O)_t-$$

wherein A is a substituted or unsubstituted hydrocarbon group or a monovalent group having such a hydrocarbon group introduced therein. The letter t is a positive integer of from 5 to 200, preferably from 10 to 100 when k is equal to 1. When t is a positive integer of less than 5, color mixing is not fully prevented. When t is a positive integer of more than 200, the solubility of the compound in water and alcohol becomes too low to handle the compound in a usual manner. The compounds become more effective when t is in the preferred range.

When k is a positive integer of at least 2, the letter t is such that the value of kxt falls in the above-defined range of t.

A is preferably a substituted or unsubstituted hydrocarbon group having 1 to 22 carbon atomsor a monovalent group having such a hydrocarbon group introduced therein. Examples of the group represented by A include alkyl and alkenyl groups such as $CH_3$—, $C_2H_5$—, $C_5H_{11}$—, $C_8H_{17}$—, $C_{12}H_{25}$—, $C_{14}H_{29}$—, $C_{16}H_{33}$—, $C_{18}H_{35}$—, $C_{18}H_{37}$—, and $C_{21}H_{43}$—; aryl and alkylaryl groups such as

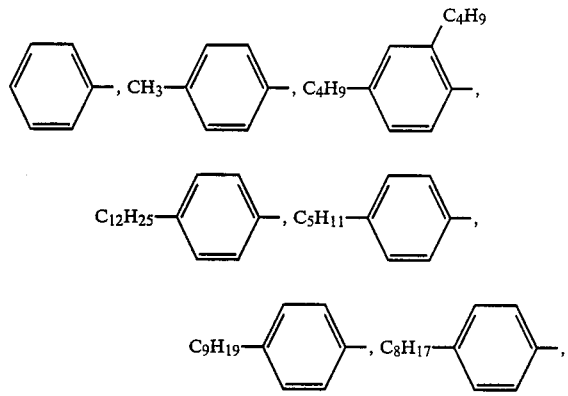

naphthyl, methylnaphthyl, dimethylnaphthyl, and hexylnaphthyl groups; and acyl groups such as $C_5H_{11}CO$— and $C_{11}H_{23}CO$—. Aryl groups are most preferred.

L is a divalent linking group, examples of which include $$-\overset{O}{\overset{\|}{C}}- \text{ and } -\overset{O}{\overset{\|}{C}}-(CH_2)_p-$$

wherein p is a positive integer having a value of at least 1.

B is a group having a valence of (k+1), example of which include divalent groups such as $$-(CH_2)_q-$$

wherein q is a positive integer having a value of at least 1, especially q is equal to 1, 2, 3, 4 and 6, $$-\underset{\underset{CH_3}{|}}{CH}-CH_2-CH_2-CH_2-,$$

$$-CH_2-CH_2-O-CH_2-CH_2-,$$

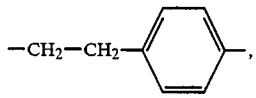

-continued

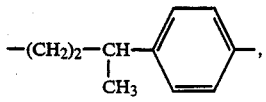

and trivalent groups such as

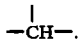

Y is a water-soluble group, examples of which include $—SO_3M$, $—SO_4M$, —COOM, $—PO(OM)_2$, and $—P(OM)_2$ wherein M is a hydrogen atom or a monovalent cation such as $Na^+$, $K^+$, $NH_4^+$, and $N(C_2H_5)_4^+$. Preferred examples are $—SO_3M$ and $—SO_4M$.

The presence of the water-soluble group in the surfactant not only prevents occurrence of agglomerates even when the sufactant is added to an emulsion-containing layer, but also prevents disordering of the coating surface when the surfactant is added to an emulsion-free layer.

Illustrative preferred, non-limiting examples of the compound of formula (I) are given below.

$C_2H_5O(CH_2CH_2O)_{20}CH_2CH_2SO_3Na$ (I-1)

$C_{12}H_{25}—O(CH_2CH_2O)_{30}(CH_2)_4SO_3Na$ (I-2)

$C_{12}H_{25}—O(CH_2CH_2O)_{50}SO_3Na$ (I-3)

$C_{18}H_{37}—O(CH_2CH_2O)_{20}(CH_2)_4SO_3K$ (I-4)

$C_{18}H_{35}—O(CH_2CH_2O)_{30}(CH_2)_3SO_3N(C_2H_5)_4$ (I-5)

(I-6)

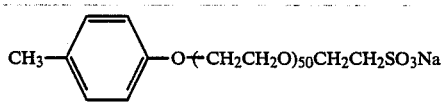

(I-7)

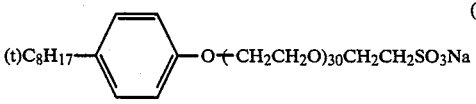

(I-8)

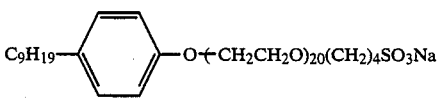

(I-9)

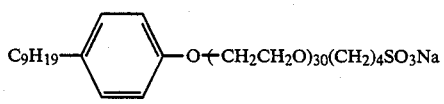

(I-10)

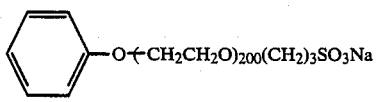

(I-11)

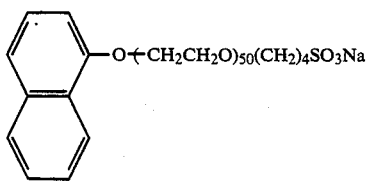

-continued (I-12)

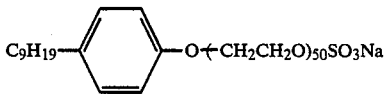

(I-13)

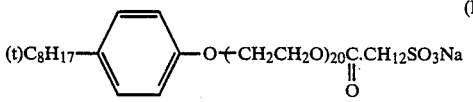

(I-14)

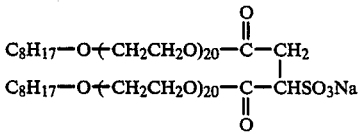

(I-15)

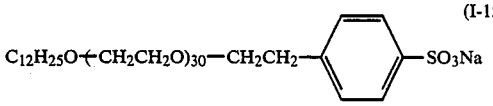

(I-16)

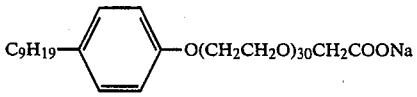

(I-17)

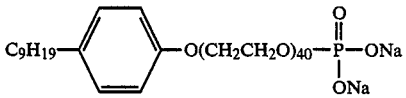

(I-18)

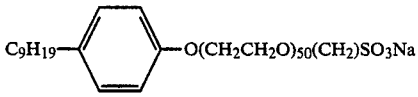

According to a second aspect of the present invention, the photosensitive material used herein contains a surfactant in the form of a compound of formula (II):

(II)

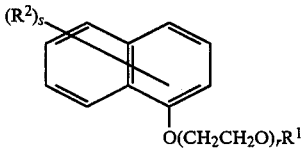

wherein $R^1$ is hydrogen or a hydrocarbon residue, $R^2$ is a hydrocarbon residue, r is a positive integer having a value of from 20 to 200, and s is 0 or a positive integer having a value of from 1 to 7.

The hydrocarbon residues include alkyl groups having 1 to 10 carbon atoms, for example, methyl, butyl, hexyl and decyl groups. Preferred examples of $R^1$ are hydrogen atom, methyl, and butyl. Preferred examples of $R^2$ are methyl, butyl, and hexyl. As is evident from these preferred examples, $R^1$ and $R^2$ each preferably have at most 10 carbon atoms.

The letter s is 0 or a positive integer having a value of from 1 to 7, and is preferably equal to 0, 1 or 2. When s is a positive integer of at least 2, $R^2$'s may be the same or different, but preferably have at most 10 carbon atoms in total.

When s is equal to 1 or 2, $R^2$ may be attached to the 2-, 3- and 4-positions, preferably to the 4-position of the naphthalene nucleus, and if desired, may be attached to the 5-, 6-, 7-, or 8-positions, preferably the 5-position of the naphthalene nucleus.

The preferred total number of carbon atoms is at most 10 when s is a positive integer of at least 1, because those compounds with the $R^2$ moiety having more than 10 carbon atoms in total are less soluble in such a solvent as water and alcohol and thus difficult to handle.

The letter r is a positive integer having a value of from 5 to 200, preferably from 20 to 100. When r is a positive integer of less than 5, color mixing is not fully prevented. When r is a positive integer of more than 200, the solubility of the compound in water and alcohol becomes too low to handle the compound in a usual manner. The compounds become more effective when r is in the preferred range.

Illustrative preferred, non-limiting examples of the compound of formula (II) are given below.

(II-1)

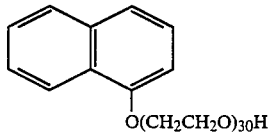

(II-2)

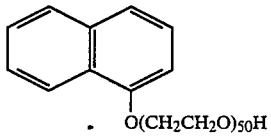

(II-3)

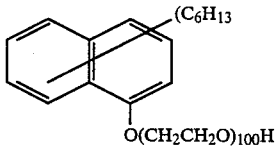

(II-4)

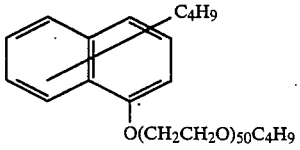

(II-5)

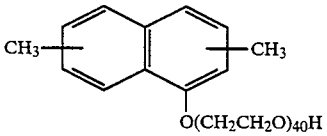

(II-6)

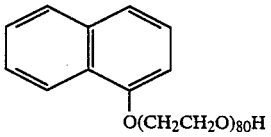

(II-7)

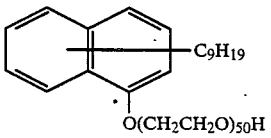

The compound according to the present invention may be added to any desired layer of photosensitive material. More particularly, the compound may be added to either a layer containing an emulsion of a dye substance (actually, an emulsion layer) or a layer free of an emulsion, for example, a protective or intermediate layer.

The compound may be added in an amount of from about 0.01 to about 2 g/m$^2$, preferably from about 0.1 to about 1 g/m$^2$, irrespective of whether it is added to an emulsion-containing layer or an emulsion-free layer. Less than 0.01 g/m$^2$ of the compound is insufficient to prevent color mixing. With more than 2 g/m$^2$ of the compound, the development retarding effect becomes too strong to achieve a satisfactory image density, and the photosensitive layer film becomes hygroscopic to lose its strength and is less stable during shelf storage in an unexposed state.

The compounds of formula (I) or (II) according to the present invention may be used alone or in admixture of two or more or in combination with a conventional surfactant. It is also contemplated to use a combination of a compound of formula (I) with a compound of formula (II).

Unlike the conventional surfactant, the compound of the present invention does not cause the dye substance to agglomerate or precipitate when it is added to an emulsion-containing layer. It causes no irregularities on the coating surface when it is added to an emulsion-free layer or when multiple layers are coated at the same time. These results are first obtained with the compounds according to the present invention.

A conventional well-known polyalkylene oxide may be used in combination with the present compound insofar as the effectiveness of the present invention is not affected.

According to the method of the present invention, an image is formed by imagewise exposing a photosensitive material and heating the material after the imagewise exposure or at the same time as the imagewise exposure.

In general, the photosensitive material contains a dye-providing substance which forms or releases a diffusible dye upon heating, which dye is transferred to a dye-fixing layer of a dye-fixing element.

In the present invention, heat development and dye transfer steps may be carried out either separately or simultaneously. Alternatively, these steps may be continuously carried out in a sense that development is followed by transfer in a single process.

For example, an image may be formed by (1) a separate method comprising imagewise exposing a photosensitive element, heating the element, placing a dye-fixing element on the photosensitive element, and maintaining them in contact, with optional heating, to transfer a mobile or diffusible dye to the dye-fixing element and (2) a concurrent method comprising imagewise exposing a photosensitive element, placing a dye-fixing element on the photosensitive element, and heating them to transfer a mobile or diffusible dye to the dye-fixing element. These methods (1) and (2) may be carried out either in the substantial absence of water or in the presence of a minor amount of water.

The heating temperature used in the heat development step, which is referred to as heat developing temperature hereinafter, ranges from about 50° C. to about 250° C., preferably from about 80° C. to about 180° C. Where heat is applied in the presence of a minor amount of water, the upper limit of the heat developing temperature is the boiling point of water. When the transfer step is carried out after completion of the heat development step, the heating temperature used in the transfer step ranges from room temperature to the heat developing temperature, preferably from 50° C. to a temperature which is 10° C. lower than the heat developing temperature.

Development irregularities resulting from variations in heat developing temperature or water amount can be prevented by adding the compound of the present invention to a photosensitive material. The compound of the present invention may also be added to any layer constituting the dye-fixing material.

In one preferred embodiment of the image forming method of the present invention, an image is formed by imagewise exposing a photosensitive material, and heating the material in the presence of a minor amount of water and a base and/or a base precursor during or after the imagewise exposure, thereby transferring a diffusible dye which is formed in an area corresponding or counter-corresponding to a silver image at the same time as development, to a dye-fixing layer. Since the reaction of forming or releasing a diffusible dye proceeds very rapidly and transfer of the diffusible dye to a dye-fixing layer takes place rapidly, this embodiment permits a color image with a high density to be produced within a short time.

The amount of water used in this embodiment is as small as at least 1/10 of the weight of the overall coatings of the photosensitive and dye-fixing elements, preferably from 1/10 of said weight to the weight of water corresponding to the maximum swollen volume of the overall coatings, and most preferably at most the weight of water corresponding to the maximum swollen volume of the overall coatings minus the weight of the overall coatings.

The coating film, when swollen, is unstable and likely to give rise to local oozing under certain conditions. To avoid such problems, the amount of water used is preferably up to the weight of water corresponding to the maximum swollen volume of the overall coatings of photosensitive and dye-fixing elements. More particularly, water is preferably applied in an amount of from 1 to 50 grams, more preferably from 2 to 35 grams, most preferably from 3 to 25 grams per square meter of the total surface area of photosensitive and dye-fixing elements.

The base and/or base precursor used in this embodiment may be incorporated in either the photosensitive element or the dye-fixing element. The base and/or base precursor may be supplied as a solution in water.

In the above-described embodiment, it is preferred to incorporate a substantially water-insoluble basic metal compound and a complexing compound capable of water-mediated complexing reaction with a metal ion of the substantially water-insoluble basic metal compound in an image forming reaction system as base precursors. Upon heating, these two compounds react with each other to form a base which raises the pH of the system. The image forming reaction system used herein designates an region where image forming reaction takes place. More particularly, the system may be any layer belonging to the photosensitive and dye-fixing elements. When more than one layer is present, the system may be either of them.

Examples of the substantially water-insoluble metal compound include carbonates, hydroxides, and oxides of zinc, aluminum, calcium, and barium. The complexing compounds are detailed in, for example, A. E. Martell and R. M. Smith, "Critical Stability Constants", Vol. 4 and 5, Plenum Press. Some illustrative examples of the complexing compound include salts of aminocarboxylic acids, iminodiacetic acids, pyridylcarboxylic acids, aminophosphoric acids, carboxylic acids (including mono-, di-, tri-, and tetracarboxylic acids with or without such a substituent as phosphono, hydroxy, oxo, ester, amide, alkoxy, mercapto, alkylthio, phosphino, etc.), hydroxamic acids, polyacrylic acids, and polyphosphoric acids with alkali metals, guanidines, amidines, and quaternary ammonium.

It is necessary to add the substantially water-insoluble metal compound and the complexing compound to at least separate layers in order to prevent them from reacting until development. For example, in a so-called mono-sheet material in which both a photosensitive element and a dye-fixing element are formed on a common support, the two compounds are added to separate layers, preferably with at least one intervening layer. More preferably, the two compounds are contained in layers which are formed on separate supports, respectively. For example, the substantially water-insoluble metal compound is contained in a photosensitive material on a first support while the complexing compound is contained in a dye-fixing material on a second support. It is also possible to supply the complexing compound as a solution by dissolving it in water to be added. The substantially water-insoluble metal compound is desirably contained as a fine particulate dispersion which is prepared by the method described in Japanese Patent Application Kokai Nos. 56-174830 and 53-102733, for example. The metal compound has an average particle size of up to 50 microns, especially up to 5 microns. The substantially water-insoluble metal compound may be added to any one of photosensitive, intermediate and protective layers, or divided portions thereof may be added to two or more such layers.

The amount of the substantially water-insoluble metal compound or the complexing compound contained in a layer on a support depends on the type of compound, particle size of the substantially water-insoluble metal compound, complexing reaction rate, and other factors. The amount is preferably up to 50% by weight, more preferably from 0.01 to 40% by weight based on the weight of a coating to be added. Where the complexing compound is supplied as a solution in water, the solution preferably has a concentration of 0.005 to 5 mol/liter, more preferably from 0.05 to 2 mol/liter of the compound. The amount of the complexing compound contained in the reaction system preferably ranges from 1/100 mol to 100 mol, more preferably from 1/10 mol to 20 mol per mol of the substantially water-insoluble metal compound.

In the practice of the image forming method of the present invention, not only the substantially water-insoluble metal compound and the complexing compound are used as the base precursor, but also the following bases and base precursors may be used.

Examples of the bases include (1) inorganic bases, for example, hydroxides, secondary and tertiary phosphates, borates, carbonates, quinolinates, and metaborates of alkali metals and alkaline earth metals; ammonium hydroxides; quaternary alkyl ammonium hydroxides; and other metal hydroxides; and (2) organic bases, for example, aliphatic amines such as trialkyl amines, hydroxylamines, and aliphatic polyamines; aromatic amines such as N-alkyl-substituted aromatic amines, N-hydroxylalkyl-substituted aromatic amines and bis[p-(dialkylamino)phenyl]methanes; heterocyclic amines, amidines; cyclic amidines; guanidines; and cyclic guanidines. The particularly preferred bases are those having a pKa value of 8 or higher.

Also included are salts of the foregoing organic bases with weak acids, for example, carbonate, bicarbonate, borate, secondary and tertiary phosphate, quinolinate, acetate, and metaborate salts. In addition, the compounds disclosed in Japanese Patent Application Kokai No. 59-218443 may preferably be used.

Base precursors are preferably those precursors which undergo any reaction under heat to release a base, for example, organic acid-base salts which are decomposed or decarbonated upon heating, and compounds which are decomposed to release amines through such reactions as intramoecular nucleophilic substituting reaction, Lossen rearrangement, Beckman rearrangement, etc. as well as those compounds which generate bases through electrolysis. Preferred examples of the former base precursor of generating a base upon heating include salts of trichloroacetic acid as described in British Patent No. 998,949; salts of alpha-sulfonylacetic acid as described in U.S. Pat. No. 4,060,420; salts of propiolic acid as described in Japanese Patent Application Kokai No. 59-180537; 2-carboxylcarboxamide derivatives as described in U.S. Pat. No. 4,088,496; salts of thermally decomposable acids with a basic component containing an organic base and an alkali metal or alkaline earth metal as described in Japanese Patent Application Kokai No. 59-195237; hydroxamcarbamates utilizing Lossen rearrangement as described in Japanese Patent Application Kokai No. 59-168439; and aldoximcarbamates capable of forming nitriles upon heating as described in Japanese Patent Application Kokai No. 59-157637. In addition, base precursors as disclosed in British Patent Nos. 998,945 and 2,079,480; U.S. Pat. No. 3,220,846; and Japanese Patent Application Kokai No. 50-22625, etc. are also useful.

The compounds which generate bases through electrolysis are also useful. One process utilizes electrolytic oxidation, typically electrolysis of various fatty acid salts. This reaction is very efficient to produce carbonate salts of alkali metals and such organic bases as guanidines and amidines.

Another process utilizes electrolytic reduction, examples of which include formation of amines through reduction of nitro and nitroso compounds, formation of amines through reduction of nitriles, and formation of p-aminophenols, p-phenylene diamines and hydrazines through reduction of nitro compounds, azo compounds, and azoxy compounds. The p-aminophenols, p-phenylene diamines and hydrazines are not only used as the base, but also directly utilized as the color image forming material.

It is also utilizable to form alkaline components through electrolysis of water in the co-presence of various inorganic salts.

Water may be applied to a photosensitive layer or a dye-fixing layer, for example, by the method described in Japanese Patent Application Kokai No. 61-147244.

Heat may be applied in the development and/or transfer step by various means including a heat block, iron and heat roller as disclosed in Japanese Patent Application Kokai No. 61-147244. It is also possible to form a layer of electroconductive material such as graphite, carbon black and metal overlying a photosensitive and/or dye-fixing material whereby electric current is conducted to the electroconductive layer to directly heat the adjoining layers.

The photosensitive material and the dye-fixing material may be placed one on the other in intimate contact by the method described in Japanese Patent Application Kokai No. 61-147244 which also discloses application and magnitude of pressure.

The silver halide used in the present invention includes silver chloride, silver bromide, silver chlorobromide, silver chloroiodide, and silver chloroiodobromide, but is not limited thereto.

More illustratively, use may be made of the silver halide emulsions described in U.S. Pat. No. 4,500,626, col. 50, Research Disclosure, June 1978, pages 19–10 (RD 17029), Japanese Patent Application Kokai No. 61-107240 and Japanese Patent Application Nos. 60-225176 and 60-228267.

The silver halide emulsions used in the practice of the present invention may be either of the surface latent image type wherein a latent image is predominantly formed on the grain surface or of the internal latent image type wherein a latent image is formed in the grain interior. A so-called core-shell emulsion may be used in which grains have a core and a shell of different phases. Also employable is a direct reversal emulsion having an internal latent image type emulsion combined with a nucleating agent.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The amount of the photosensitive silver halide coated preferably ranges from 1 mg to 10 grams of silver per square meter.

In the practice of the present invention, an organic metal salt may be used as an oxidizing agent in combination with the photosensitive silver halide. It is necessary that the photosensitive silver halide and the organic metal salt be in contact with or close to each other. Preferred among these organic metal salts are organic silver salts.

Useful examples of the organic compounds which can be used to form the organic silver salt oxidizing agents are described in Japanese Patent Application Kokai No. 61-107240, and U.S. Pat. No. 4,500,626, columns 52–53. Also useful are silver salts of carboxylic acids having an alkynyl group such as silver phenylpropiolate as described in Japanese Patent Application No. 60-113235 and silver acetylene as described in Japanese Patent Application No. 60-90089. A mixture of two or more organic silver salts may be used.

The organic silver salt is used in an amount of from about 0.01 to about 10 mol, preferably from 0.01 to 1 mol per mole of the photosensitive silver halide. The combined amount of the photosensitive silver halide and organic silver salt coated preferably ranges from about 50 mg to about 10 grams of silver per square meter.

The silver halides used in the practice of the present invention may be spectrally sensitized with methine dyes and other dyes. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Illustrative examples are the sensitizing dyes disclosed in Japanese Patent Application Kokai Nos. 59-180550 and 60-140335 and Research Disclosure, June 1978, pages 12–13 (RD 17029); and the sensitizing dyes of heat-decoloring nature disclosed in Japanese Patent Application Kokai No. 60-111239 and Japanese Patent Application No. 60-172967. These sensitizing dyes may be used individually or as a combination thereof. A combination of sensitizing dyes is frequently used for supersensitization.

In addition to the sensitizing dye, the emulsion may contain a dye which itself has no spectral sensitization function or a material which does not substantially absorb visible light, but is capable of supersensitization. Such supersensitizing compounds are disclosed in the following U.S. Patents:

| | | |
|---|---|---|
| 2,933,390 | 3,615,613 | 3,615,641 |
| 3,617,295 | 3,635,721 | 3,743,510. |

These sensitizing dyes may be added to the emulsion during, before or after chemical ripening, or before or after nucleation of silver halide grains according to the teachings of U.S. Pat. Nos. 4,183,756 and 4,225,666. The amount of the sensitizing dye is generally from about $10^{-8}$ to about $10^{-2}$ mol per mol of the silver halide.

In the present invention, the photosensitive material contains an image forming material in the form of a compound which, when silver ion is reduced into silver at elevated temperatures, produces or releases a mobile or diffusible dye in direct or inverse proportion to the reaction. These compounds are simply referred to as dye-providing substances hereinafter.

Typical of the dye-providing substances which can be used in the present invention are compounds capable of forming a dye through oxidative coupling reaction, that is, couplers. The couplers may be four- or two-equivalent couplers. Also useful is a two-equivalent coupler which has an anti-diffusion group as a coupling-off group so that it forms a diffusible dye through oxidative coupling reaction. Illustrative examples of the developing agents and couplers are described in detail in, for example, T. H. James, "The Theory of the Photographic Process", 4th Ed., pages 291–334 and 354–361, as well as the following Japanese Patent Application Kokai Nos.

| | | |
|---|---|---|
| 58-123533, | 58-149046, | 58-149047, |
| 59-111148, | 59-124399, | 59-174835, |
| 59-231539, | 59-231540, | 60-2950, |
| 60-2951, | 60-14242, | 60-23474, |
| 60-66249. | | |

Another example of the dye-providing substances is a compound having the function of releasing or diffusing a diffusible dye imagewise. The compounds of this type may be represented by the following formula [L I]:

$$(\text{Dye-X})_n\text{—Y} \qquad \text{(L I)}$$

wherein Dye represents a dye group, a temporary short-waved dye group, or a dye precursor group; X represents a valence bond or a bridging linkage; and Y represents a group which, in correspondence or counter-correspondence to photosensitive silver salt having a latent image distributed imagewise, produces a difference in diffusibility of the compound represented by $(\text{Dye-X})_n$—Y or releases Dye, the diffusibility of Dye released being different from that of the compound represented by $(\text{Dye-X})_n$—Y, and n represents an integer of 1 or 2, when n=2, the Dye-X's may be the same or different.

Exemplary of the dye-providing substances having general formula [L I] there may be given dye developing agents in the form of a hydroquinone-type developing agent having a dye moiety attached thereto as disclosed in U.S. Pat. Nos. 3,134,764; 3,362,819; 3,597,200; 3,544,545 and 3,482,972. In addition, substances which release a diffusible dye through intramolecular nucleophilic substitution reaction are disclosed in U.S. Pat. No. 3,980,479 and substances which releases a diffusible dye through intramolecular rewind reaction of an isooxazolone ring are disclosed in Japanese Patent Application Kokai No. 49-111628.

Another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese Patent Application Kokai Nos. 53-35533, 53-110827, 54-130927, and 56-164342. Dye-providing substances which release a diffusible dye through a similar mechanism are also known in Japanese Patent Application Kokai No. 60-244873 which discloses compounds which releases a diffusbile dye upon cleavage of an N-O bond by the remainder of reducing agent.

Also useful is a non-diffusible compound (LDA compound) which releases a diffusible dye through donor-acceptor reaction in the presence of a base, but substantially stops dye release when reacted with an oxidant of the reducing agent as disclosed in Japanese Patent Application Kokai No. 59-185333.

In the systems to which these substances are applied, a diffusible dye is released or diffused where no development has taken place and no dye is released or diffused where development has taken place.

Also known are substances which release a diffusible dye where development has occurred. The substances which release a diffusible dye through reaction with an oxidant of the reducing agent are known as DDR couplers, that is, couplers having a diffusible dye as an eliminatable group, and described in British Patent No. 1,330,524, Japanese Patent Publication No. 48-39165, and U.S. Pat. No. 3,443,940.

The systems using these color developing agents have the serious problem that the resulting image can be contaminated with oxidation decomposition products of a reducing agent. To overcome this problem, a dye-releasing compound (DRR compound) has been proposed which itself has a reducing ability and does not need a reducing agent. Typical examples of these dye-providing substances are described in the following patents. U.S. Pat. Nos.:

| | | |
|---|---|---|
| 3,443,939, | 3,725,062, | 3,728,113, |
| 3,928,312, | 4,053,312 | 4,055,428 |
| 4,336,322 | 4,500,626 | |

Japanese Patent Application Kokai Nos.

| | | |
|---|---|---|
| 51-104343, | 53-3819, | 57-179840, |
| 58-116537 | 59-65839, | 59-69839, |

Research Disclosure No. 17465.

Exemplary of the dye-providing substances which can be used in the practice of the present invention there may be given those compounds described in U.S. Pat. No. 4,500,626, columns 22–44, with the compounds identified therein as compound Nos. (1)–(3), (10)–(13), (16)–(19), (28)–(30), (33)–(35), (38)–(40), and (42)–(64) being favorable among others. Also useful are the compounds described in Japanese Patent Application Kokai No. 61-124941.

The compound of formula (I) or (II) according to the present invention is more effective when the dye-provided substance mentioned above has a lower molecular weight.

The dye-prividing substances used herein other than the foregoing include dye-silver compounds in which an organic silver salt is combined with a dye as disclosed in Research Disclosure, May 1978, pages 54–58, azo dyes used in heat development silver dye bleaching as disclosed in U.S. Pat. No. 4,235,957 and Research Disclosure, April 1976, pages 30–32, and leuco dyes as disclosed in U.S. Pat. Nos. 3,985,565 and 4,022,617.

The foregoing dye-providing substances and other hydrophobic additives such as image formation promotors to be described later may be introduced into a layer of photosensitive material by any well-known methods, for example, the method described in U.S. Pat. No. 2,322,027.

To this end, an organic solvent having a high boiling point or an organic solvent having a low boiling point may be used. Examples of the high-boiling organic solvent include a phthalic acid alkyl ester (such as dibutyl phthalate, dioctyl phthalate, etc.), a phosphoric acid ester (such as diphenyl phosphate, triphenyl phosphate, tricresyl phosphate, dioctylbutyl phosphate, etc.), a citric acid ester (such as tributyl acetylcitrate, etc.), a benzoic acid ester (such as octyl benzoate, etc.), an alkylamide (such as diethyl laurylamide, etc.), a fatty acid ester (such as dibutoxyethyl succinate, dioctyl azelate, etc.), and a trimesic acid ester (such as tributyl trimesate, etc.). Examples of the organic solvent having a low boiling point of about 30° C. to 160° C. include a lower alkyl acetate (such as ethyl acetate, butyl acetate, etc.), ethyl propionate, sec-butyl alcohol, methyl isobutyl ketone, betaethoxyethyl acetate, methyl cellosolve acetate, cyclohexanone, etc. Mixtures of the above-described high boiling organic solvents and low boiling organic solvents may also be used. For example, the dye-providing substance is first dissolved in a high or low-boiling organic solvent. The solution of the dye-providing substance may then be dispersed in a hydrophilic colloid.

The high-boiling organic solvent may be used in the practice of the present invention in amounts of up to about 10 grams, preferably up to about 5 grams per gram of the dye-providing substance.

Further, it is possible to use a method for dispersion in polymers as described in Japanese Patent Publication No. 51-39853 and Japanese Patent Application Kokai No. 51-59943.

In the case of a substantially water-insoluble compound, it may be finely divided and dispersed in a binder although the above-mentioned method is applicable.

Moreover, various surface-active agents may be used in combination with the compounds of the present invention when the dye-providing substance and other hydrophobic substances are dispersed in a hydrophilic colloid. For this purpose, the surface-active agents illustrated in Japanese Patent Application Kokai No. 59-157636, pages 37–38 may be used.

In the practice of the present invention, it is desired that the photosensitive material contain a reducing material. The reducing materials used herein include commonly known reducing agents and the above-mentioned dye-providing substances having reducing nature. Also included are reducing agent precursors which themselves have no reducing nature, but exhibit reducing nature under the action of a nucleophilic reagent or heat during development.

Examples of the reducing agents used herein include those described in U.S. Pat. Nos. 4,500,626 (columns 49–50) and 4,483,914 (column 30–31), Japanese Patent Application Kokai No. 60-140335 (pages 17–18), 60-128436, 60-128437, 60-128438, and 60-128439. Also useful are the reducing agent precursors described in Japanese Patent Application Kokai Nos. 56-138736 and 57-40245 and U.S. Pat. No. 4,330,617.

Combinations of various reducing agents may also be used as described in U.S. Pat. No. 3,039,869.

The amount of the reducing agent added preferably ranges from 0.01 to 20 mol, more preferably from about 0.1 to about 10 mol per mol of silver.

In the practice of the present invention, the photosensitive material may contain a compound which activates development and at the same time, stabilize an image. Preferred examples of the compound are described in U.S. Pat. No. 4,500,626, columns 51–52.

In the practice of the present invention, the photosensitive material may contain an anti-fogging agent or photographic stabilizer. Examples of the compound used for such purpose are azoles and azaindenes described in Research Disclosure, December 1978, pages 24–25, nitrogen-containing carboxylic acids and phosphoric acids described in Japanese Patent Application Kokai No. 59-168442, mercapto compounds and metal salts thereof described in Japanese Patent Application Kokai No. 59-111636, and acetylene compounds described in Japanese Patent Application No. 60-228267.

In the practice of the present invention, the photosensitive material may contain an image toning agent if desired. Examples of the useful toning agents are described in Japanese Patent Application Kokai No. 61-147244.

In order to provide a wide range of color within the chromaticity diagram using the three primary colors, yellow, magenta and cyan, the heat-developable photosensitive material used in the present invention may include at least three silver halide emulsion layers having sensitivity in different spectra. Typical combinations of at least three silver halide emulsion layers having sensitivity in different spectra are a combination of blue-sensitive emulsion layer/green-sensitive emulsion layer/red-sensitive emulsion layer and a combination of green-sensitive emulsion layer/red-sensitive emulsion layer/infrared-sensitive emulsion layer. Each of these photosensitive layers may be divided into two or more plies, if desired.

The photosensitive material used in the present invention may contain various additives known for use in heat-developable photosensitive materials and include any layers in addition to the photosensitive layers, for example, a protective layer, an intermediate layer, an antistatic layer, an anti-halation layer, a peeling layer for facilitating separation from a dye-fixing element, and a matte layer. The additives used herein include plasticizers, matte agents, sharpness modifying dyes, anti-halation dyes, surface-active agents, brighteners, anti-slippery agents, antioxidants, anti-fading agents as described in Research Disclosure, June 1978, pages 9–15, Japanese Patent Application Kokai No. 61-88256. It is a common practice for the protective layer to contain an organic or inorganic matte agent for preventing adhesion. The protective layer may also contain a mordant and a UV absorber. Each of the protective and intermediate layers may consist of two or more plies.

The intermediate layer may contain a reducing agent, a UV absorber, and a white pigment such as titanium oxide in order to prevent color fading or color mixing. White pigment may be added to not only the intermediate layer, but also to any emulsion layer in order to improve sensitivity.

The photographic material according to the present invention is comprised of a photosensitive element which forms or releases a dye through heat development and a dye-fixing element which fixes the dye. Particularly, systems of forming an image through diffusion transfer of a dye need the photosensitive and dye-fixing elements as requisite elements. They are generally classified into two typical forms, one form having photosensitive and dye-fixing elements separately applied on two separate supports and another form having both photosensitive and dye-fixing elements applied on a common support. With respect to the relation of the photosensitive element and the dye-fixing element to one another, to the support, and to a white reflective layer, reference may be made to the descriptions of Japanese Patent Application Kokai No. 61-147244, pages 15–16 and U.S. Pat. No. 4,500,626, col. 57.

The dye-fixing element preferably used in the present invention has at least one layer containing a mordant and a binder. The mordant may be selected from those known in the photographic art, for example, the compounds described in Japanese Patent Application Kokai No. 61-88256.

The dye-fixing element may optionally be provided with any auxiliary layers, for example, a protective layer, peeling layer, and anti-curling layer, in addition to the above-mentioned layers. Provision of a protective layer is effective. One or more of these layers may contain a hydrophilic thermal solvent, plasticizer, anti-fading agent, UV absorber, sliding agent, matte agent, antioxidant, dispersed vinyl compound for increasing dimensional stability, surface-active agent, brightener, etc. Particularly in a system of carrying out heat development and dye transfer at the same time in the presence of a small amount of water, a base and/or base precursor is preferably contained in a dye-fixing material in order to increase the shelf stability of the photosensitive material. Illustrative examples of these additives are described in Japanese Patent Application Kokai No. 61-88256, pages 24–32.

An image formation promotor may also be used in the photosensitive material and/or dye-fixing material in the practice of the present invention. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surface-active agents, and compounds capable of interacting with silver or silver ion. It should be noted that these compounds generally have multiple functions and thus possess some of the above-mentioned promoting effects combined. For further detail, reference is to be made to Japanese Patent Application Kokai No. 61-88256, pages 17–20, which is incorporated herein by reference.

In the practice of the present invention, a variety of development inhibitors may be used in the photosensitive material and/or dye-fixing material for the purpose of obtaining a consistent image irrespective of variations in processing temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds and their precursors, and the like. Specific examples are disclosed in Japanese Patent Application Kokai Nos. 60-108837, 60-192939, 60-230133, and 60-230134.

Also useful are those compounds which release mercapto compounds upon heating, for example, those described in the following Japanese Patent Application Kokai Nos.

| | | |
|---|---|---|
| 61-053632 | 61-067851 | 61-124941 |
| 61-147244 | 61-182039 | 61-184539 |
| 61-185743 | 61-185744 | 61-188540 |

The binders employed in the photosensitive material and/or dye-fixing material in the practice of the present invention may be hydrophilic. The typical hydrophilic binder is a transparent or translucent hydrophilic binder, examples of which include natural substances, for example, proteins such as gelatin, gelatin derivatives and cellulose derivatives and polysaccharides such as starch, dextran, pluran, gum arabic, etc.; and synthetic polymers, for example, water-soluble polyvinyl compounds such as polyvinyl alcohol, polyvinyl pyrrolidone, acrylamide polymer, etc. Another example of the synthetic polymer compound is a dispersed vinyl compound in a latex form which is used for the purpose of increasing the dimensional stability of a photographic material. These binders may be used alone or in admixture. The binders may be coated in amounts of up to 20 grams per square meter, preferably up to 10 grams per square meter, and most preferably up to 7 grams per square meter.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

Any of the layers of the photosensitive material and the dye-fixing material according to the present invention, including photographic emulsion, dye-fixing and other layers, may contain inorganic or organic hardeners. Illustrative examples of the hardeners are those set forth in Japanese Patent Application Kokai Nos. 59-157636 and 61-147244. They may be used alone or in combination.

To promote dye transfer, a hydrophilic thermal solvent which is solid at room temperature and liquid at elevated temperatures may be incorporated in the photosensitive or dye-fixing material. The hydrophilic thermal solvent may be incorporated in the photosensitive or dye-fixing material or both the materials. The layer to which the thermal solvent is added may be any desired layer including emulsion, intermediate, protective, and dye-fixing layers, preferably a dye-fixing layer and/or an adjoining layer. Examples of the thermal solvent include ureas, pyridines, amides, sulfonamides, imides, alcohols, oximes, and other heterocyclics. A high-boiling organic solvent may be incorporated in the photosensitive and/or dye-fixing material in order to promote dye transfer.

The support suitable for use in the photosensitive material and/or dye-fixing material according to the present invention must withstand the processing temperature. Exemplary of ordinary supports there may be given not only glass, paper, polymer film, metal and analogues, but also those described as supports in Japanese Patent Application Kokai Nos. 61-147244.

The photosensitive material and/or dye-fixing material according to the present invention may have an electroconductive heating element layer serving as heating means for heat development or diffusion transfer of dye. Such a transparent or opaque heating element may be provided in the form of a resistance heating element using a conventional well-known technique. The resistance heating element may be prepared by utilizing a thin film of a semiconductive inorganic material or an organic thin film of conductive fine particles dispersed in a binder. The materials which can be used in these methods are described in Japanese Patent Application Kokai Nos. 61-29835, 61-145544 and 61-209446.

In the practice of the present invention, the heat-developable photosensitive, protective, intermediate, undercoat, backcoat, dye-fixing, and other layers may be applied by any conventional coating methods, typically, the method described in U.S. Pat. No. 4,500,626, columns 55–56.

The light source for imagewise exposure to record an image in the heat-developable photosensitive may be any radiation including visible light. In general, light sources used in ordinary color printing may be used, for example, tungsten lamps, mercury lamps, halide lamps such as iodide lamps, xenon lamps, laser light sources, CRT light sources, and light-emitting diodes (LED) as set forth in Japanese Patent Application Kokai No. 61-147244 and U.S. Pat. No. 4,500,626, col. 56.

The photographic material according to the present invention may be processed using any of various well-known heat developing apparatus. Useful apparatus are described in Japanese Patent Application Kokai Nos. 59-75247, 59-177547, 59-181353, and 60-18951 and Japanese Utility Model Application No. 60-116734.

Most preferred embodiments of the image forming method according to the present invention are given below.

(1) The photosensitive material is heated in the presence of water.

(2) The photosensitive material is heated in the presence of water and a base and/or a base precursor.

(3) The photosensitive material contains an emulsion of a dye-providing substance.

(4) A reducing agent is added to the photosensitive material in combination with the dye-providing substance.

As described above, the image forming method of the present invention uses a photosensitive material which contains a compound of general formula (I) or (II) as a surface-active agent. When the compound or surface-active agent is added to an emulsion layer, it does not break the emulsion and thus prevents the dye-providing substance from precipitating as agglomerates. When a coating liquid containing an emulsion is coated, the addition of the compound prevents occurrence of agglomerates, eliminating any trouble.

When the present compound is added to a layer which does not contain an emulsion, the layer as coated has a smooth surface and contains no defects as opposed to the conventional surface-active agents. These lead to advantages in manufacture.

The addition of the present compound prevents irregular development which otherwise occur with variations in the amount of water or heating temperature used in heat development. Layer thickness variations caused by irregularities of paper support are also minimized, and image variations associated therewith are prevented.

Although paper irregularities appear more adversely when a substantially water-insoluble metal compound is used in combination with a complexing compound as a base precursor, the present invention is effective in mitigating such disadvantages. Interlayer color mixing and fogging are also prevented. As a whole, the present method contributes to improvements in photographic properties.

EXAMPLES

In order that those skilled in the art may better understand how the present invention may be practiced, the following examples are given by way of illustration and not by way of limitation.

EXAMPLE 1

Preparation of Silver Benzotriazole Emulsion

A silver benzotriazole emulsion was prepared by dissolving 28 grams of gelatin and 13.2 grams of benzotriazole in 300 ml of water. The resulting solution was agitated at 40° C. To the solution was added 17 grams of silver nitrate in 100 ml water over a period of 2 minutes. The resulting silver benzotriazole emulsion was adjusted to such pH that an excess salt precipitated, and the excess salt was removed. The emulsion was then adjusted to pH 6.30, obtaining a silver benzotriazole emulsion in a yield of 400 grams.

Preparation of Silver Acetylene Dispersion

A silver acetylene dispersion was prepared by dissolving 20 grams of gelatin and 4.6 grams of 4-acetylaminophenyl acetylene in 1000 ml of water and 200 ml of ethanol. The solution was agitated at 40° C.

To the solution was added 4.5 grams of silver nitrate in 200 ml of water over a period of 5 minutes. The dispersion was adjusted to such pH that an excess salt precipitated, and the excess salt was removed. The dispersion was adjusted to pH 6.3, obtaining a silver acetylene dispersion in a yield of 300 grams.

Preparation of Silver Halide Emulsions

A silver halide emulsion used in first and fifth layers was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.40 μm (bromine 50 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a third layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol%).

After water rinsing and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Next, a dispersion of a dye-providing substance in gelatin was prepared as follows.

Preparation of Gelatin Dispersion of Dye-Providing Substance

Five (5) grams of yellow dye-providing substance (A) having the formula shown below was dissolved together with 0.5 grams of succinic acid-2-ethylhexyl ester sodium sulfonate surface-active agent and 2.5 grams of triisononyl phosphate in 30 ml of ethyl acetate by heating at about 60° C., obtaining a homogeneous solution. The solution was mixed with 100 grams of a 3 wt% lime-treated gelatin solution by agitation, and the mixture was dispersed with a homogenizer for 10 minutes at 10,000 rpm. This dispersion is called yellow dye-providing substance dispersion.

A magenta dye-providing substance dispersion was prepared by the same procedure as above except that a magenta dye-providing substance (B) was used as the dye-providing substance and 2.5 grams of tricresyl phosphate was used as the high-boiling solvent.

A cyan dye-providing substance dispersion was prepared by the same procedure as above except that a cyan dye-providing substance (C) was used as the dye-providing substance.

Using these preparations, there was prepared a color photosensitive material No. 101 of multi-layer structure as shown in the following formulation:

| [FORMULATION] |
|---|
| Sixth layer |
| gelatin (coating weight 800 mg/m$^2$) |
| hardener*2 (coating weight 16 mg/m$^2$) |
| silica*4 (coating weight 100 mg/m$^2$) |
| zinc hydroxide (coating weight 300 mg/m$^2$) |
| Fifth layer: Green-sensitive emulsion layer |
| silver chlorobromide emulsion (bromine 50 mol %, coating weight 400 mg/m$^2$ of Ag) |
| sensitizing dye D-1 (coating weight $10^{-6}$ mol/m$^2$) |
| hardener*2 (coating weight 16 mg/m$^2$) |
| yellow dye-providing substance (A) (coating weight 400 mg/m$^2$) |
| gelatin (coating weight 800 mg/m$^2$) |
| high-boiling solvent*3 (coating weight 200 mg/m$^2$) |
| Fourth layer: Intermediate layer |
| gelatin (coating weight 900 mg/m$^2$) |
| hardener*2 (coating weight 18 mg/m$^2$) |
| zinc hydroxide (coating weight 300 mg/m$^2$) |
| Third layer: Red-sensitive emulsion layer |
| silver chlorobromide emulsion (bromine 80 mol %, coating weight 300 mg/m$^2$ of Ag) |
| silver acetylene emulsion (coating weight 60 mg/m$^2$ of Ag) |
| silver benzotriazole emulsion (coating weight 20 mg/m$^2$ of Ag) |
| sensitizing dye D-2 (coating weight $8 \times 10^{-7}$ mol/m$^2$) |
| hardener*2 (coating weight 18 mg/m$^2$) |
| magenta dye-providing substance (B) (coating weight 400 mg/m$^2$) |
| gelatin (coating weight 800 mg/m$^2$) |
| high-boiling solvent*4 (coating weight 300 mg/m$^2$) |
| Second layer: Intermediate layer |
| gelatin (coating weight 800 mg/m$^2$) |
| hardener*2 (coating weight 16 mg/m$^2$) |
| zinc hydroxide (coating weight 300 mg/m$^2$) |
| First layer: Infrared-sensitive emulsion layer |
| silver chlorobromide emulsion (bromine 50 mol %, coating weight 300 mg/m$^2$ of Ag) |
| silver acetylene emulsion (coating weight 25 mg/m$^2$ of Ag) |
| silver benzotriazole emulsion (coating weight 50 mg/m$^2$ of Ag) |
| sensitizing dye D-3 (coating weight $10^{-8}$ mol/m$^2$) |
| hardener*2 (coating weight 16 mg/m$^2$) |
| cyan dye-providing substance (C) (coating weight 300 mg/m$^2$) |
| gelatin (coating weight 600 mg/m$^2$) |
| high-boiling solvent*3 (coating weight 150 mg/m$^2$) |
| Support*1 |

*1 polyethylene terephthalate film of 180 μm thick
*2 1,2-bis(vinylsulfonylacetamide)ethane
*3 $(iso\text{-}C_9H_{19}O)_3P = O$
*4 size 4 μm Dye-providing Substance
(A)
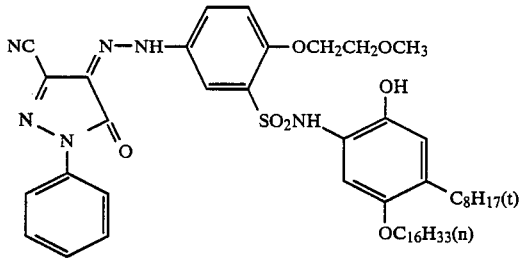
(B)
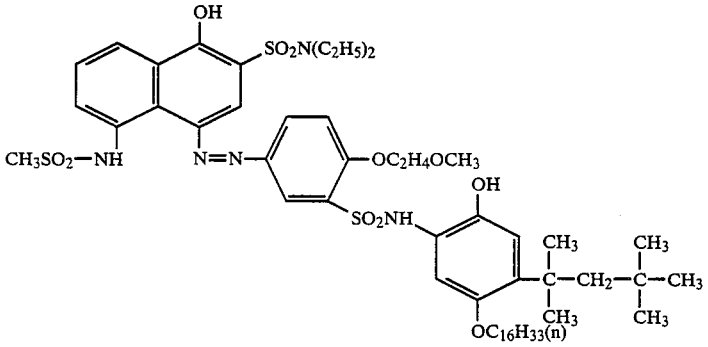
(C)
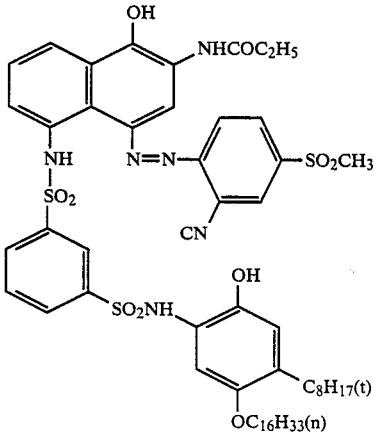
(D-1)
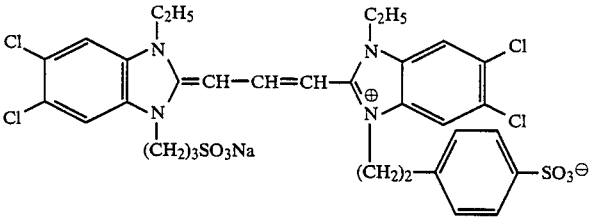
(D-2)
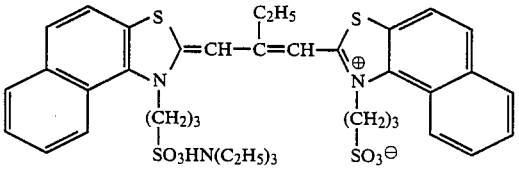

-continued

Dye-providing Substance

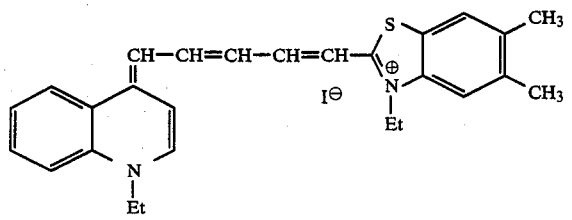

(D-3)

Next, the preparation of a dye-fixing material will be described.

Preparation of Dye-Fixing Material

First, 10 grams of poly(methyl acrylate-co-N,N,N-trimethyl-N-vinylbenzyl ammonium chloride) having a ratio of methyl acrylate to vinylbenzyl ammonium chloride of 1:1 was dissolved in 175 ml of water and then combined with 100 grams of 10% lime-treated gelatin. To the mixture was added 25 ml of an aqueous solution of 4% 2,4-dichloro-6-hydroxy1,3,5-triazine. The mixture was evenly spread on a paper substrate laminated with polyethylene having titanium dioxide dispersed therein, thereby forming a layer having a uniform wet thickness of 90 μm.

Another coating solution was prepared by mixing 6 grams of guanidine picolinate, 18 ml of water, 20 grams of 10% gelatin solution, and 4.8 ml of an aqueous solution of 1% succinic acid-2-ethylhexyl ester sodium sulfonate. The coating solution was applied onto the mordant coated substrate to a wet thickness of 30 μm. Drying resulted in a dye-fixing material having a mordant layer which is designated D-1.

Multilayered color photosensitive material Nos. 102 to 108 were prepared by the same procedure as the foregoing color photosensitive material No. 101 except that surface-active agents A and B were added to some layers as shown in Table 1. Surface-active agent A has the following chemical formula:

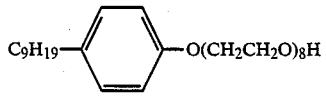

Surface-active agent B is Compound (I-9):

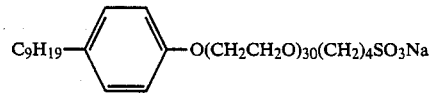

TABLE 1

| Layer | 102 | 103 | 104 | 105 | 106 | 107 | 108 |
|---|---|---|---|---|---|---|---|
| | Photosensitive material No. | | | | | | |
| 6th | — | — | A 50 | A 50 | A 100 | — | B 100 |
| 5th | A 100 | A 50 | A 50 | — | — | B 100 | — |
| 4th | — | — | A 50 | A 50 | A 100 | — | B 100 |
| 3rd | A 100 | A 50 | A 50 | — | — | B 100 | — |
| 2nd | — | — | A 50 | A 50 | A 100 | — | B 100 |
| 1st | A 100 | A 50 | A 50 | — | — | B 100 | — |

In Table 1, the unit used is mg/m$^2$. For example, "A 100" means that the corresponding layer contains 100 mg/m$^2$ of surface-active agent A.

Multilayered color light-sensitive material Nos. 101–108 were exposed for one second at 500 lux under a tungsten lamp through three color separation filters G, R, and IR having a continuously varying density. It should be noted that filter G is a 500–600 nm band pass filter, filter R is a 600–700 nm band pass filter, and filter IR is a filter transmitting light having wavelengths of at least 700 nm.

Water was applied by means of a wire bar in an amount of 10 ml per square meter to the emulsion surface of the exposed photosensitive material, which was superimposed on dye-fixing material D-1 such that their effective surfaces faced one another. After heating for 30 seconds through heat rollers at such a temperature that the temperature of the wet film reached 90° C., the dye-fixing material was peeled from the photosensitive material. The dye-fixing material then bore thereon clear images of yellow (Y), magenta (M), and cyan (C) corresponding to the three color separation filters G, R and IR. Each color image was observed to determine the degree of color mixing.

The photosensitive materials prior to use were precisely observed for the presence of agglomerates and the coating surface state.

The results are shown in Table 2.

TABLE 2

| Photo-sensitive material | Presence of agglomerate | Coating surface state | Color mixing |
|---|---|---|---|
| 101* | No | Good | Mutual color mixing in each of three colors |
| 102* | Much | Good | No |
| 103* | Some | Good | Cyan mixed in magenta image, magenta mixed in yellow image |
| 104* | Some | Good | No |
| 105* | No | Somewhat disordered | Color mixing as in No. 103 |
| 106* | No | Markedly disordered | No |
| 107 | No | Good | No |
| 108 | No | Good | No |

*samples outside the scope of the present invention

The same exposure, water application and heat development procedures as described above were carried out on photosensitive material Nos. 102, 106, 107 and 108. A change in the density of each color image was measured by varying the amount of water applied to 8, 10, and 12 ml/m$^2$ and the heat-developing temperature to 87°, 90° and 93° C. It was found that photosensitive material Nos. 107 and 108 showed a less density change under varying conditions than photosensitive material Nos. 102 and 106.

It is evident that the surface-active agent of the present invention is superior to the conventional one in all respects including agglomeration, coating surface state, processing parameter change.

EXAMPLE 2

Photosensitive material Nos. 201 to 203 were prepared by the same procedure as photosensitive material No. 108 except that the surface-active agent added to the second, fourth and sixth layers was changed as shown below.

| Photosensitive material | Surface-active agent |
|---|---|
| No. 201 | Compound (I-8) |
| No. 202 | Compound (I-18) |
| No. 203 | Compound (I-6) |

Photosensitive material Nos. 201 to 203 were evaluated for agglomeration, coating surface state, processing parameter change by the same procedures as in Example 1. The results were equally satisfactory to photosensitive material No. 108.

EXAMPLE 3

Photosensitive material Nos. 301 and 302 were prepared by the same procedure as inExample 1 except that compound (II-2) was used as the surface-active agent. Table 3 shows the layers to which the surface-active agent was added.

TABLE 3

| | Photosensitive material No. | |
|---|---|---|
| Layer | 301 | 302 |
| 6th | — | (II-2) 100 mg/m$^2$ |
| 5th | (II-2) 100 mg/m$^2$ | — |
| 4th | — | (II-2) 100 mg/m$^2$ |
| 3rd | (II-2) 100 mg/m$^2$ | — |
| 2nd | — | (II-2) 100 mg/m$^2$ |
| 1st | (II-2) 100 mg/m$^2$ | — |

Photosensitive material Nos. 301 and 302 were processed and examined by the same procedures as in Example 1.

The results are shown in Table 4.

TABLE 4

| Photosensitive material | Presence of agglomerate | Coating surface state | Color mixing |
|---|---|---|---|
| 301 | No | Good | No |
| 302 | No | Good | No |

The same exposure, water application and heat development procedures as described above were carried out in photosensitive material Nos. 301 and 302. A change in the density of each color image was measured by varying the amount of water applied to 7 ml/m$^2$ and the heat-developing temperature to 98? C. It was found that photosensitive material Nos. 301 and 302 showed no color mixing and a less density change than photosensitive material Nos. 101 to 106.

It is evident that the surface-active agent of the present invention is superior to the conventional one in all respects including agglomeration, coating surface state, processing parameter change.

EXAMPLE 4

Photosensitive material Nos. 401 to 403 were prepared by the same procedure as photosensitive material No. 302 except that the surface-active agent added to the second, fourth and sixth layers was changed as shown below.

| Photosensitive material | Surface-active agent |
|---|---|
| No. 401 | Compound (II-1) |
| No. 402 | Compound (II-6) |
| No. 403 | Compound (II-7) |

Photosensitive material Nos. 401 to 403 were evaluated for agglomeration, coating surface state, processing parameter change by the same procedures as in Example 1. The results were equally satisfactory to photosensitive material No. 202.

Obviously, numerous modifications and variations of the present invention are possible in light of the above teachings. It is therefore to be understood that within the scope of the appended claims, the invention may be practiced otherwise than as specifically described herein.

We claim:

1. A method for forming an image, comprising the steps of:

imagewise exposing a heat developable photosensitive material comprising on a support at least (a) a photosensitive silver halide, (b) a binder, (c) a dye-providing substance which forms or releases a diffusible dye in response or counter-response to the reduction of the silver halide into silver at elevated temperatures, and (d) an anionic surfactant of formula (I):

$$[X-(L)_m-]_k-(B)_n-Y \quad (I)$$

wherein

X is a monovalent group containing a polyethylene oxide chain,

L is a divalent linking group,

Y is a water-soluble group, m is equal to 0 or 1, k is a positive integer having a value of at least 1, B is a group having a valence of (k+1), and n is equal to 0 or 1, or a compound of formula (II):

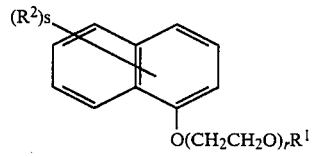

(II)

wherein $R^1$ is hydrogen or a hydrocarbon residue, $R^2$ is a hydrocarbon residue, r is a positive integer having a value of from 5 to 200, and s is 0 or a positive integer having a value of from 1 to 7, and during or after the imagewise exposure of the photosensitive material, heating the heat developable photosensitive material to form an image.

2. The image forming method of claim 1 wherein the heat developable photosensitive material is heated in the presence of water.

3. The image forming method of claim 1 wherein the heat developable photosensitive material is heated in the presence of water and a base and/or a base precursor.

4. The image forming method of claim 1 wherein the heat developable photosensitive material contains an emulsion of the dye-providing substance.

5. The image forming method of claim 1 wherein a reducing agent is added to the heat developable photosensitive material in combination with the dye-providing substance.

6. The image forming method of claim 3 wherein the base precursor comprises a combination of a substantially water-insoluble metal compound and a complexing compound capable of complexing reaction with a metal ion of the water-insoluble metal compound.

* * * * *